US009532599B2

(12) United States Patent
Liu

(10) Patent No.: US 9,532,599 B2
(45) Date of Patent: Jan. 3, 2017

(54) ELECTRONIC CIGARETTE

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 680 days.

(21) Appl. No.: 13/958,373

(22) Filed: Aug. 2, 2013

(65) Prior Publication Data

US 2015/0007835 A1 Jan. 8, 2015

(30) Foreign Application Priority Data

Jul. 5, 2013 (CN) ..... 2013 2 0401923 U

(51) Int. Cl.
*A24F 47/00* (2006.01)

(52) U.S. Cl.
CPC ..... *A24F 47/008* (2013.01)

(58) Field of Classification Search
CPC ..... A61M 15/06
See application file for complete search history.

(56) References Cited

U.S. PATENT DOCUMENTS 5,322,075 A * 6/1994 Deevi ..... H05B 3/44 131/194
5,665,262 A * 9/1997 Hajaligol ..... A24F 47/008 131/194
2003/0075188 A1* 4/2003 Adiga ..... A24F 47/004 131/185
2006/0180163 A1* 8/2006 Thompson ..... A24F 13/02 131/175
2008/0257368 A1* 10/2008 Wilson ..... A24C 5/3406 131/328
2010/0200008 A1* 8/2010 Taieb ..... A24F 47/008 131/360
2012/0227752 A1* 9/2012 Alelov ..... A61M 11/005 131/273
2012/0312313 A1* 12/2012 Frija ..... A24F 47/002 131/329
2012/0318882 A1* 12/2012 Abehasera ..... A61M 11/041 239/1
2013/0037041 A1* 2/2013 Worm ..... A24F 47/008 131/329
2013/0213419 A1* 8/2013 Tucker ..... A24F 47/008 131/328

* cited by examiner

*Primary Examiner* — Jason L Lazorcik
*Assistant Examiner* — Cynthia Szewczyk
(74) *Attorney, Agent, or Firm* — Tim Tingkang Xia, Esq.; Locke Lord LLP

(57) ABSTRACT

An electronic cigarette comprising an atomizer and a first case configured for accommodating the atomizer is provided; the atomizer includes a heating mechanism, a breather pipe, and oil storage cotton, the heating mechanism is received inside the breather pipe, and the oil storage cotton envelops an outer surface of the breather pipe; wherein, the heating mechanism is positioned along an axial direction of the breather pipe, and has a shape matching an inner surface of the breather pipe. The heating mechanism in the electronic cigarette has a large effective heating area so that more smoke can be generated by the atomizer.

14 Claims, 2 Drawing Sheets

ELECTRONIC CIGARETTE

CROSS-REFERENCE TO RELATED APPLICATIONS

This non-provisional application claims priorities under 35 U.S.C. §119(a) on Patent Application No. 201320401923.9 filed in P.R. China on Jul. 5, 2013, the entire contents of which are hereby incorporated by reference.

FIELD OF THE INVENTION

The present invention relates to the field of electronic devices, and more particularly, relates to an electronic cigarette.

BACKGROUND OF THE INVENTION

In the prior art, a heating mechanism of an electronic cigarette is usually formed by a nickel-chromium alloy wire coiled into a spiral shape. The heating mechanism is mounted on a cross section of a corresponding stationary bracket to generate heat. However, in this method, an effective heating area of the electronic cigarette is too limited. Therefore, smoke generated by an atomizer of the electronic cigarette is less, and it may be difficult to meet the need of a user.

SUMMARY OF THE INVENTION

The objective of the present invention is to provide an electronic cigarette including a heating mechanism that has a large effective heating area, aiming at the defect that the effective heating area of the heating mechanism of the electronic cigarette is too limited in the prior art so that less smoke can be generated by the atomizer of the electronic cigarette.

The technical solutions of the present invention for solving the technical problems are as follows.

An electronic cigarette comprising an atomizer and a first case configured for accommodating the atomizer is provided; the atomizer includes a heating mechanism, a breather pipe, and oil storage cotton, the heating mechanism is received inside the breather pipe, and the oil storage cotton envelops an outer surface of the breather pipe; wherein, the heating mechanism is positioned along an axial direction of the breather pipe, and has a shape matching an inner surface of the breather pipe.

Advantageously, the heating mechanism comprises a heating sleeve; a shape of the heating sleeve matches a shape of the inner surface of the breather pipe; an outer surface of the heating sleeve fits the inner surface of the breather pipe; and a wall of the heating sleeve defines a plurality of first through-holes configured for enabling smoke oil to enter the heating sleeve.

Advantageously, the plurality of first through-holes are strewn all around the wall of the heating sleeve and arranged in an array.

Advantageously, the heating mechanism comprises a heating slice; the heating slice has a shape matching the inner surface of the breather pipe, and fits the inner surface of the breather pipe; and the heating slice defines a plurality of second through-holes configured for enabling smoke oil to enter the heating slice.

Advantageously, the plurality of second through-holes are defined on the heating slice and arranged in an array.

Advantageously, the heating mechanism comprises a heating coil having a rolling shape; the heating coil is mounted on the inner surface of the breather pipe; and the heating coil and the breather pipe are coaxial with each other.

Advantageously, the breather pipe is formed by weaving glass fibers, and gaps formed between the glass fibers form passages for guiding smoke oil.

Advantageously, the electronic cigarette further comprises a second case and a battery accommodated in the second case; and the second case is connected with the first case detachably.

Advantageously, a first conductive sleeve and a first electrode column are formed on an end of the first case that is adjacent to the second case; both the first conductive sleeve and the first electrode column are connected with the heating mechanism; the first conductive sleeve is mounted on the second case detachably, and the first electrode column is mounted inside the first conductive sleeve and insulated with the first conductive sleeve;

a second conductive sleeve and a second electrode column are formed on an end of the second case that is adjacent to the first case; both the second conductive sleeve and the second electrode column are electrically connected with the battery respectively; the second conductive sleeve is mounted on the second case detachably; the second electrode column is mounted inside the second conductive sleeve and insulated with the second conductive sleeve;

the first conductive sleeve and the second conductive sleeve define corresponding thread structures; wherein, when the first conductive sleeve is connected with the second conductive sleeve by thread connection, the first electrode column abuts the second electrode column and is thereby electrically connected with the second electrode column.

Advantageously, the electronic cigarette further includes at least one sticker attached on an outer surface of the first case.

Advantageously, the electronic cigarette further includes a binding layer formed between the sticker and the first case and configured for attaching the sticker to the first case.

Advantageously, the electronic cigarette further includes a cigarette-holder and a cigarette-holder cap configured for keeping the cigarette-holder cleaning, and the cigarette-holder and the cigarette-holder cap are mounted on an end of the first case that is far away from the second case.

Advantageously, the electronic cigarette further includes a lamp assembly mounted on an end of the second case that is far away from the first case, and the lamp assembly is electrically connected with the battery.

Advantageously, the electronic cigarette further includes a sealing ring positioned between the cigarette-holder and the atomizer and configured to prevent smoke oil from flowing into the cigarette-holder.

Advantageously, the heating mechanism is made of nickel-chromium alloy or iron-chromium alloy.

By implementing the electronic cigarette in the present invention, the following advantages can be achieved. The heating mechanism of the electronic cigarette provided by the present invention has a shape corresponding to the breather pipe, and is positioned along an axial direction of the breather pipe. Thus, an effective heating area of the electronic cigarette can be enlarged, and the atomizer can generate more smoke.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

Figure 1:
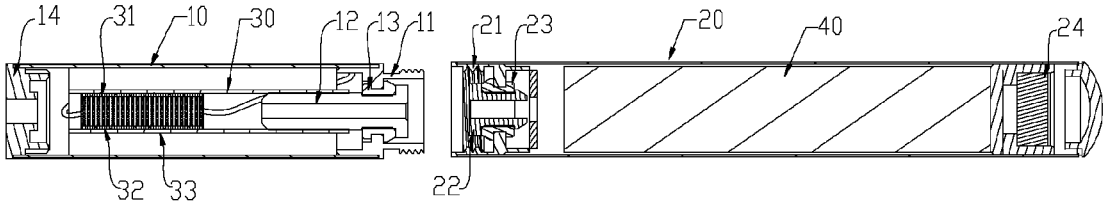
FIG. 1 is a structural schematic view of an electronic cigarette of an embodiment of the present invention.

FIG. 1 shows an electronic cigarette of an embodiment of the present invention. The electronic cigarette comprises a first case 10, a second case 20, an atomizer 30, and a battery 40. The atomizer 40 is configured to atomize smoke oil, and is accommodated in the first case 10. The battery 40 is configured to supply power to the atomizer 30, and is accommodated in the second case 20. The first case 10 is connected with the second case 20 detachably.

In this embodiment, the first case 10 is approximately cylindrical, and can also have other shapes. A first conductive sleeve 11 and a first electrode column 12 are formed on an end of the first case 10 that is adjacent to the second case 20. Both the first conductive sleeve 11 and the first electrode column 12 are electrically connected with a heating mechanism 31. The first conductive sleeve 11 is substantially cylindrical, and is mounted on the first case 10 detachably. One end of the first conductive sleeve 11 is open, and the other end of the first conductive sleeve 11 has a first bottom surface. The first bottom surface defines a first hole, and the first hole is circular. A first insulating ring 13 is fixed in the first hole. The first electrode column 12 passes through the first insulating ring 13, and is mounted in the first conductive sleeve 11. The first electrode column 12 and the first conductive sleeve 11 are mutually insulated by the first insulating ring 13. Furthermore, the first conductive sleeve 11 defines an outer thread.

The electronic cigarette further includes at least one sticker attached on an outer surface of the first case 10 and a binding layer configured for attaching the sticker to the first case. The sticker can slip over, be embedded in, or be pasted on the binding layer. Furthermore, the sticker can be printed by trademarks, logos, etc., or designed to have a three-dimensional shape of words and/or patterns to improve the beauty of the electronic cigarette.

The electronic cigarette further includes a cigarette-holder and a cigarette-holder cap 14 configured for keeping the cigarette-holder cleaning, and the cigarette-holder and the cigarette-holder cap 14 are mounted on an end of the first case 10 that is far away from the second case 20. The electronic cigarette further includes a sealing ring (not shown) positioned between the cigarette-holder and the atomizer 30 and configured to prevent smoke oil from flowing into the cigarette-holder. The sealing ring is made of rubber or other materials.

In this embodiment, the second case 20 is approximately cylindrical, and can also have other shapes. A second conductive sleeve 21 and a second electrode column 22 are formed on an end of the second case 20 that is adjacent to the first case 10. The second conductive sleeve 21 and the second electrode column 22 are electrically connected with the battery 40 respectively. The second conductive sleeve 20 is substantially cylindrical, and is mounted on the second case 20 detachably. One end of the second conductive sleeve 20 is open, and the other end of the second conductive sleeve 20 has a second bottom surface. The second bottom surface defines a second hole, and the second hole is circular. A second insulating ring 23 is fixed in the second hole. The second electrode column 22 passes through the second insulating ring 23, and is mounted in the second conductive sleeve 21. The second electrode column 22 and the second conductive sleeve 21 are mutually insulated by the second insulating ring 23. The second conductive sleeve 21 defines an inner thread corresponding to the outer thread on the first conductive sleeve 11. When the second conductive sleeve 21 is connected with the first conductive sleeve 11 by thread connection, the second conductive sleeve 21 is electrically connected with the first conductive sleeve 11, and the second electrode column 22 is electrically connected with the first electrode column 12. This thread connection method has advantages of easy disassembly and installation, firm connection, and stable electronic connection.

It is understood that the first conductive sleeve 11 can also define an inner thread, and the second conductive sleeve 21 can also define an outer thread corresponding to the inner thread of the first conductive sleeve 11.

The electronic cigarette further includes a lamp assembly 24 mounted on an end of the second case 20 that is far away from the first case 10. The lamp assembly 24 is electrically connected with the battery 40, and lighting of the lamp assembly 24 is used to simulate burning of a cigarette end.

The atomizer 30 includes a heating mechanism 31, a breather pipe 32, and oil storage cotton 33. The heating mechanism 31 is used to atomize smoke oil, and is mounted inside the breather pipe 32. The heating mechanism 31 is positioned along an axial direction of the breather pipe 32, and has a shape matching an inner surface of the breather pipe 32. The oil storage cotton 33 is used for storing smoke oil, and envelops an outer surface of the breather pipe 32. The breather pipe 32 is formed by weaving glass fibers, and gaps between the glass fibers form passages for guiding the smoke oil. The gaps between the glass fibers further have functions of supporting and ventilation. Furthermore, the breather pipe 32 made of the glass fibers has an advantage of good heat resistance, which prevents the breather pipe 32 from melting due to heat generated by the heating mechanism 31.

Figure 2:
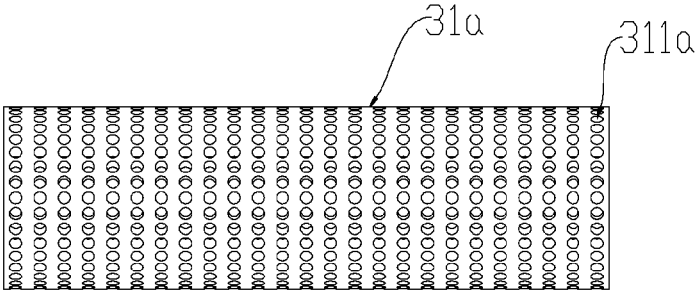
FIG. 2 is a structural schematic view of a heating mechanism of the electronic cigarette shown in FIG. 1, according to a first embodiment.

As shown in FIG. 2, a heating sleeve 31*a* can be adopted as the heating mechanism 31, and the shape of the heating sleeve 31*a* matches the inner surface of the breather pipe 32. An outer surface of the heating sleeve 31*a* fits the inner surface of the breather pipe 32. Correspondingly, an end of the breather pipe 32 that is far away from the battery 40 defines a mounting groove (not shown), and the mounting groove is positioned to surround the inner surface of the breather pipe 32. An end of the heating sleeve 31*a* is embedded in the mounting groove. Additionally, the heating sleeve 31*a* and the breather pipe 32 may not fit each other, that is, there can be a gap between the heating sleeve 31*a* and the breather pipe 32. Advantageously, the width of the gap is 0.3 mm.

The heating sleeve 31*a* defines a plurality of first through-holes 311*a* configured for enabling smoke oil to enter the heating sleeve 31*a*. The plurality of first through-holes 311*a* are strewn all around the wall of the heating sleeve 31*a* and arranged in an array. Furthermore, each of the first through-holes 311*a* is a circular hole with a radius ranging from 0.8 mm to 1.5 mm, and a distance between centers of every two adjacent ones of the first through-holes 311*a* ranges from 2.8 mm to 4.5 mm. By testing, when the radii and center distances of the first through-holes 311*a* are in the above-described ranges, the atomizing effect of the heating sleeve 31*a* achieves the best. Additionally, the shapes of the first through-holes 311*a* can be one or more kinds of shapes selected from oval, polygon, and curve. The heating sleeve 31*a* is made of metal having a high resistivity, such as nickel-chromium alloy or iron-chromium alloy.

Figure 3:
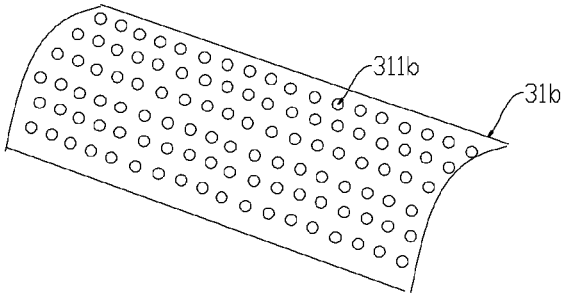
FIG. 3 is a structural schematic view of a heating mechanism of the electronic cigarette shown in FIG. 1, according to a second embodiment.

As shown in FIG. 3, a heating slice 31*b* can be adopted as the heating mechanism 31. The heating slice 31*b* has a curve surface matching the inner surface of the breather pipe 32, and fits the inner surface of the breather pipe 32. The heating slice 31*b* can fit the inner surface of the breather pipe 32 by pasting or embedding.

The heating slice 31*b* defines a plurality of second through-holes 311*b*. The second through-holes 311*b* are arranged in an array and configured for enabling smoke oil to arrive at an inside of the heating slice 31*b*. The heating slice 31*b* is made of metal having a high resistivity, such as nickel-chromium alloy or iron-chromium alloy.

Figure 4:
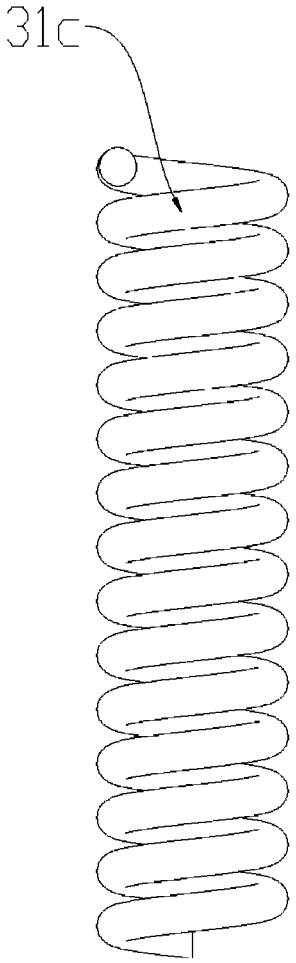
FIG. 4 is a structural schematic view of a heating mechanism of the electronic cigarette shown in FIG. 1, according to a third embodiment.

As shown in FIG. 4, a heating coil 31*c* can be adopted as the heating mechanism 31, and the heating coil 31*c* has a rolling shape formed by rolling a metal wire. The heating coil 31*c* is mounted on and fits the inner surface of the breather pipe 32, and the heating coil 31*c* and the breather pipe 32 are coaxial with each other. Furthermore, the heating coil 31*c* can be embedded in the inner surface of the breather pipe 32 directly. The metal wire of the heating coil 31*c* is enveloped by an insulating layer. Besides, when the heating coil 31*c* is manufactured, a gap is formed between every two adjacent ones of the circles of the heating coil 31*c*, so that smoke oil is enabled to enter the heating coil 31*c*. When an axial length of the heating coil 31*c* is one third of a length of the breather pipe 32, and a width of the gap between every two adjacent ones of the circles of the heating coil 31*c* is a half of a diameter of the wire of the heating coil 31*c*, the most smoke can be generated. The heating coil 31*c* is made of metal having a high resistivity, such as nickel-chromium alloy or iron-chromium alloy.

In the inspiration of the present invention, those ordinary skills in the art can also make many modifications without breaking away from the subject of the present invention and the protection scope of the claims. All these modifications belong to the protection of the present invention.

What is claimed is:

1. An electronic cigarette comprising an atomizer and a first case configured for accommodating the atomizer; the atomizer including a heating mechanism, a breather pipe, and oil storage cotton, the heating mechanism received inside the breather pipe, and the oil storage cotton enveloping an outer surface of the breather pipe; wherein, the heating mechanism is positioned along an axial direction of the breather pipe, and has a shape matching an inner surface of the breather pipe;

wherein the breather pipe is formed by weaving glass fibers, and gaps formed between the glass fibers form passages for guiding smoke oil;

wherein the heating mechanism comprises a heating sleeve; a shape of the heating sleeve matches a shape of the inner surface of the breather pipe; an outer surface of the heating sleeve fits the inner surface of the breather pipe; and a wall of the heating sleeve defines a plurality of first through-holes configured for enabling smoke oil to enter the heating sleeve.

2. The electronic cigarette according to claim 1, wherein, the plurality of first through-holes are strewn all around the wall of the heating sleeve and arranged in an array;

wherein each of the first through-holes is a circular hole with a radius ranging from 0.8 mm to 1.5 mm, and a distance between centers of every two adjacent ones of the first through-holes ranges from 2.8 mm to 4.5 mm.

3. The electronic cigarette according to claim 1, wherein, the heating mechanism is made of nickel-chromium alloy or iron-chromium alloy.

4. An electronic cigarette comprising an atomizer and a first case configured for accommodating the atomizer; the atomizer including a heating mechanism, a breather pipe, and oil storage cotton, the heating mechanism received inside the breather pipe, and the oil storage cotton enveloping an outer surface of the breather pipe; wherein, the heating mechanism is positioned along an axial direction of the breather pipe, and has a shape matching an inner surface of the breather pipe;

wherein the breather pipe is formed by weaving glass fibers, and gaps formed between the glass fibers form passages for guiding smoke oil;

wherein, the heating mechanism comprises a heating slice; the heating slice has a shape matching the inner surface of the breather pipe, and fits the inner surface of the breather pipe; and the heating slice defines a plurality of second through-holes configured for enabling smoke oil to enter the heating slice.

5. The electronic cigarette according to claim 4, wherein, the plurality of second through-holes are defined on the heating slice and arranged in an array.

6. An electronic cigarette comprising an atomizer and a first case configured for accommodating the atomizer; the atomizer including a heating mechanism, a breather pipe, and oil storage cotton, the heating mechanism received inside the breather pipe, and the oil storage cotton enveloping an outer surface of the breather pipe; wherein, the heating mechanism is positioned along an axial direction of the breather pipe, and has a shape matching an inner surface of the breather pipe;

wherein the breather pipe is formed by weaving glass fibers, and gaps formed between the glass fibers form passages for guiding smoke oil;

wherein, the heating mechanism comprises a heating coil having a rolling shape; the heating coil is mounted on the inner surface of the breather pipe; and the heating coil and the breather pipe are coaxial with each other; the metal wire of the heating coil is enveloped by an insulating layer; a gap is formed between every two adjacent ones of the circles of the heating coil, so that smoke oil is enabled to enter the heating coil.

7. The electronic cigarette according to claim 6, wherein an axial length of the heating coil is one third of a length of the breather pipe, and a width of the gap between every two adjacent ones of the circles of the heating coil is a half of a diameter of the wire of the heating coil.

8. The electronic cigarette according to claim 7, wherein, the electronic cigarette further comprises a second case and a battery accommodated in the second case; and the second case is connected with the first case detachably.

9. The electronic cigarette according to claim 8, wherein, a first conductive sleeve and a first electrode column are formed on an end of the first case that is adjacent to the second case; both the first conductive sleeve and the first electrode column are connected with the heating mechanism; the first conductive sleeve is mounted on the second case detachably, and the first electrode column is mounted inside the first conductive sleeve and insulated with the first conductive sleeve;

a second conductive sleeve and a second electrode column are formed on an end of the second case that is adjacent to the first case; both the second conductive sleeve and the second electrode column are electrically connected with the battery respectively; the second conductive sleeve is mounted on the second case detachably; the second electrode column is mounted inside the second conductive sleeve and insulated with the second conductive sleeve;

the first conductive sleeve and the second conductive sleeve define corresponding thread structures; wherein, when the first conductive sleeve is connected with the second conductive sleeve by thread connection, the first electrode column abuts the second electrode column and is thereby electrically connected with the second electrode column.

10. The electronic cigarette according to claim 9, wherein, the electronic cigarette further includes at least one sticker attached on an outer surface of the first case.

11. The electronic cigarette according to claim 10, wherein, the electronic cigarette further includes a binding layer formed between the sticker and the first case and configured for attaching the sticker to the first case.

12. The electronic cigarette according to claim 11, wherein, the electronic cigarette further includes a cigarette-holder and a cigarette-holder cap configured for keeping the cigarette-holder cleaning, and the cigarette-holder and the cigarette-holder cap are mounted on an end of the first case that is far away from the second case.

13. The electronic cigarette according to claim 12, wherein, the electronic cigarette further includes a lamp assembly mounted on an end of the second case that is far away from the first case, and the lamp assembly is electrically connected with the battery.

14. The electronic cigarette according to claim 13, wherein, the electronic cigarette further includes a sealing ring positioned between the cigarette-holder and the atomizer and configured to prevent smoke oil from flowing into the cigarette-holder.

* * * * *